US006402482B1

(12) United States Patent
Lee

(10) Patent No.: US 6,402,482 B1
(45) Date of Patent: Jun. 11, 2002

(54) SMALL TURBO COMPRESSOR

(76) Inventor: Heon Seok Lee, #101-201 Samsung Purun Apt., Jeonmin-dong, Youseung-ky, Daejeon (KR)

( * ) Notice: Subject to any disclaimer, the term of this patent is extended or adjusted under 35 U.S.C. 154(b) by 0 days.

(21) Appl. No.: 09/646,094

(22) PCT Filed: Mar. 18, 1999

(86) PCT No.: PCT/KR99/00120

§ 371 (c)(1),
(2), (4) Date: Dec. 14, 2000

(87) PCT Pub. No.: WO99/49222

PCT Pub. Date: Sep. 30, 1999

(30) Foreign Application Priority Data

Mar. 20, 1998 (KR) ..... 98/9555

(51) Int. Cl.[7] ..... F04B 23/00; F04B 25/00
(52) U.S. Cl. ..... 417/243; 417/406
(58) Field of Search ..... 417/44.1, 406, 417/243, 13, 203; 415/68, 1, 56; 60/684; 62/175

(56) References Cited

U.S. PATENT DOCUMENTS

| | | | | | |
|---|---|---|---|---|---|
| 3,584,973 | A | * | 6/1971 | Lambiris | 417/13 |
| 3,640,646 | A | * | 2/1972 | Hornschuch et al. | 417/203 |
| 4,105,372 | A | * | 8/1978 | Mishina et al. | 417/243 |
| 4,125,345 | A | * | 11/1978 | Yoshinaga et al. | 417/243 |
| 4,231,702 | A | * | 11/1980 | Gopalakrishnan et al. | 415/56 |
| 4,362,462 | A | * | 12/1982 | Blotenberg | 415/1 |
| 4,594,858 | A | * | 6/1986 | Shaw | 62/175 |
| 5,042,970 | A | * | 8/1991 | Rodgers | 417/406 |
| 5,473,899 | A | * | 12/1995 | Viteri | 60/684 |
| 5,490,760 | A | * | 2/1996 | Kotzur | 415/68 |
| 6,050,780 | A | * | 4/2000 | Hasegawa et al. | 417/44.11 |

* cited by examiner

*Primary Examiner*—Teresa Walberg
*Assistant Examiner*—Leonid M Fastovsky
(74) *Attorney, Agent, or Firm*—Jacobson Holman, PLLC

(57) ABSTRACT

A multi-stage turbo compressor including a turbine driven by a high-pressure gas from a low-stage compressor's outlet; and a high-stage compressor driven by a power transmitted through an axis directly connected to the turbine. The gas that passed the turbine is returned to a first-stage compressor's inlet.

11 Claims, 4 Drawing Sheets

SMALL TURBO COMPRESSOR

TECHNICAL FIELD

The present invention relates to a small turbo compressor. More particularly, it relates to a small turbo compressor which is capable of providing clean compressed air excluding oil and enhanced energy efficiency.

BACKGROUND ART

Air compressors for industrial use are characterized as reciprocating, screw and turbo compressors. The reciprocating, screw and turbo compressors are used for less than 50 horsepower (hp), about 50 to 200 hp., and over 600 hp., respectively. The turbo compressor is of excellent durability and provides clean air excluding oil as compared with reciprocating and screw ones, and is superior to them. However, since there is a limit to the development of gear techniques, a turbo compressor of less than 600 hp. has not been manufactured, and Japanese IHI that developed the 110,000-RPM increasing gear mechanism first proposed a 100-hp turbo compressor. The turbo compressor which depends on the quality of the increasing gear cannot be manufactured to a small size of less than 100 hp. In the presently-available turbo compressor since impellers are driven by a motor and an increasing gear, the outlet width of an impeller of the final stage compressor becomes too small, and there is a limit to being in a high compression ratio with a small amount of gas. For example, when trying to produce gas of 10 bar by a 200-hp turbo compressor, the outlet width of the impeller of the final stage compressor is about 2 mm, so an axial clearance cannot be secured and the efficiency of the final stage compressor is too low to be of practical use. Even in case of producing a pressure of 20 bar by a 500-hp turbo compressor, it cannot operate because of the same reason as the above.

Therefore, in spite of various advantages of the turbo compressor, it cannot be used for less than 200 hp.

In order to realize a turbo compressor with a small amount of air, the present invention employs compressors driven by an external power and a turbine driven by a part of the compressed air, and connected to the final stage of the compressor to produce about a pressure of 11 bar with a small amount of gas. For low-stage compressor such as a first-stage or second-stage compressor, their impellers are driven by a conventional method such as increasing gear, and a high-stage compressor (third-, fourth-, and final stage compressor) employs a turbine driving mechanism using compressed air produced from the low-stage compressor in order to provide the satisfactory rotational speed not to decrease the outlet width of the impeller of the high-stage compressor in case of a small amount of gas (generally, less than 1.0Kg/sec). According to a conventional gear driving, the rotational speed can hardly exceed 70,000 RPM because of the limit of gear mechanism, and in order to produce a high compression ratio with the small rotational speed, the outlet width of the impeller becomes small, which cannot be of practical use.

SUMMARY OF THE INVENTION

It is an object of the present invention to provide a small turbo compressor which can obviate disadvantages of conventional compressor techniques, and assures an increase in energy efficiency, supply of clean compressed air, and satisfactory operation in a high compression region with a small amount of gas.

In order to achieve the above object, the present invention provides a multi-stage turbo compressor including a turbine driven by a high-pressure gas from a low-stage compressor's outlet; and a high-stage compressor driven by a power transmitted through an axis directly connected to the turbine. The gas that passed the turbine is returned to a first-stage compressor's inlet. First and second compressors are driven by a high-speed motor directly connected thereto. Or, the first and second compressors are driven by a motor whose rotational speed is increased by an increasing gear.

BRIEF DESCRIPTION OF DRAWINGS

The present invention will become more fully understood from the detailed description given hereinbelow and the accompanying drawings which are given by way of illustration only, and thus are not limitative of the present invention, and wherein.

BEST MODE FOR CARRYING OUT THE INVENTION

Figure 1:
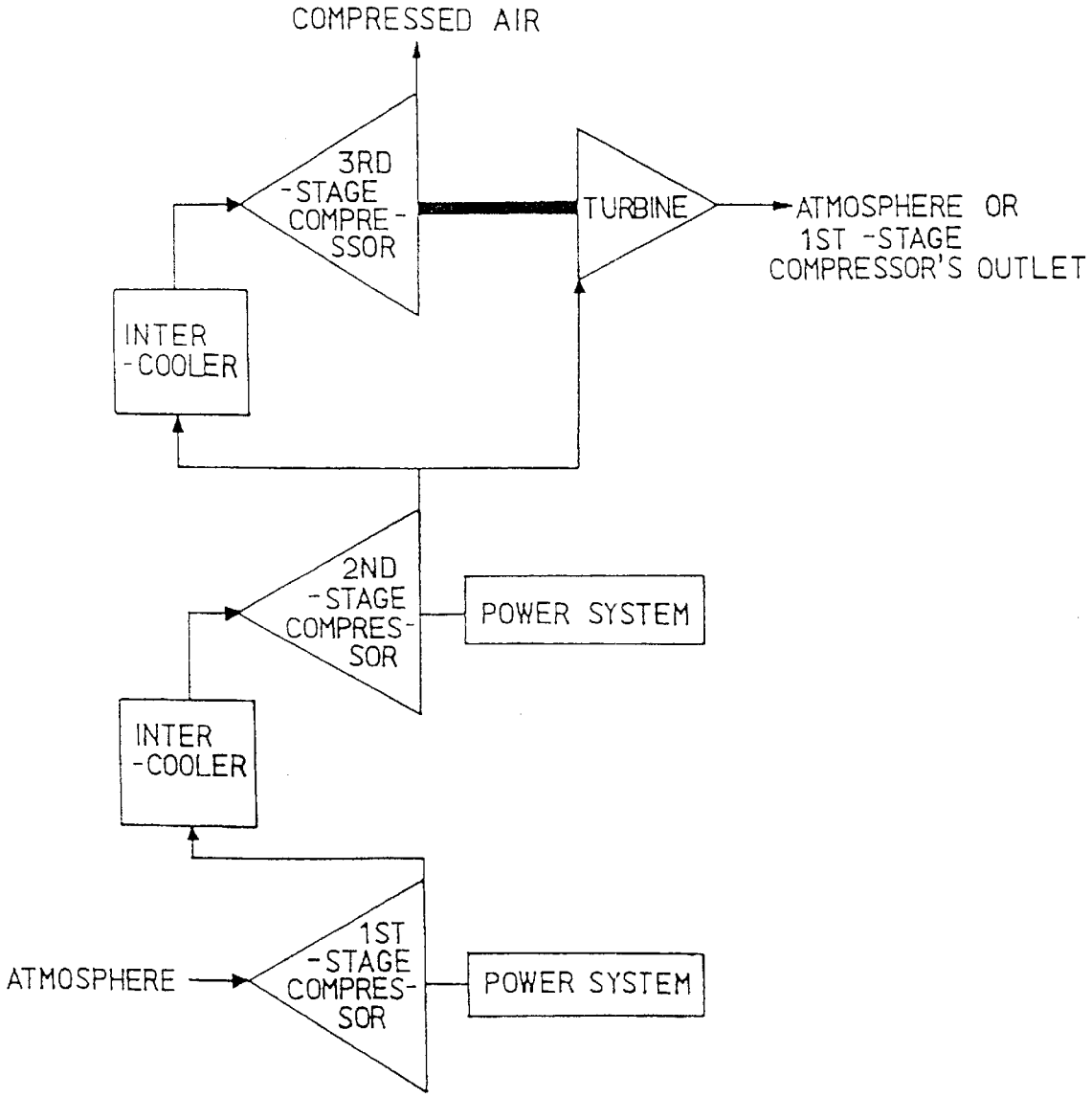
FIG. 1 schematically shows the basic concept of the present invention having two centrifugal compressors and one centrifugal turbine.

FIG. 1 depicts the basic concept of a turbo compressor of the present invention. As shown in FIG. 1, first-stage and second-stage compressors are driven by an engine or motor, and an inter-cooler is used between each stage to reduce the consumption of power. The turbine is driven by air of about a pressure of 4 bar from an outlet of the second-stage compressor, and the third-stage compressor connected to the turbine is operated more than 100,000 RPM, thus producing a pressure of 10 bar. with a small amount of gas. It is hard to apply the conventional turbo compressor to the amount of gas of less than 1 Kg/sec, and the present invention provides a method of overcoming the conventional restrictions by driving the high-stage compressor with the turbine. The first- and second-stage compressors inhale gas more than the air actually produced, and it is possible to operate in the region where the impeller's efficiency is high. Recently, Japanese IHI disclosed a two-stage small turbo compressor of 100 hp with a newly developed gear of 110,000 RPM, but this compressor does not provide a pressure of 8 bar and over because of its final stage. This pressure does not reach a pressure of 10 bar that a screw compressor provides, and since the number of the axial rotation of the increasing gear must exceed 170,000 RPM for use of third-stage compressor, the pressure cannot be more raised and its application is impossible.

The following is a result obtained from a 100-hp compressor producing a pressure of 12 bar by the use of gear of 70,000 RPM significantly lower than IHI's one of 110,000 RPM.

| | Pressure (bar) | Temperature (K) | Amount of gas (Kg/sec) | Notes |
|---|---|---|---|---|
| 0. | 1.00 | 300.00 | 0.2219 | under the atmospheric condition |
| 1. | 1.00 | 288.80 | 0.3221 | condition of mixture of air from turbine's outlet and inhaled air |
| 2. | 2.80 | 409.30 | 0.3221 | First-stage compressor: Compression ratio 2.8 & Efficiency 0.82 |
| 3. | 2.80 | 310.00 | 0.3221 | Heat exchanger's pressure loss is disregarded for simple calculation |
| 4. | 6.72 | 418.80 | 0.3221 | Second-stage compressor: Compression ratio 2.8 & Efficiency 0.81 |
| 5. | 6.72 | 310.00 | 0.2219 | Heat exchanger's pressure loss is disregarded for simple calculation |
| 6. | 12.0 | 379.90 | 0.2219 | Third-stage compressor: Compression ratio 1.786, Efficiency 0.82, Rotational speed 170,00 RPM. Compression ratio is determined from second-stage compressor and turbine's power balance. |
| 7. | 1.0 | 264.1 | 0.1002 | Air from the turbine outlet |

The respective performances of the aboves are as follows:

| Item | Value | Evaluation |
|---|---|---|
| Amount of gas for IHI | 4.02 CFM | conventional screw compressor - 4; IHI's -4.65; IHI's is not high in pressure so cannot be compared |
| Energy efficiency | 0.932 | IHT's – about 0.85; inter-cooling is performed twice in the present invention while inter-cooling is once performed for IHI |
| Amount of inhaled gas | 402 CFM | 400 for conventional screw compressor; 465 for IHI |
| Output pressure | 12 Kg/cm$^2$ | it is similar to conventional screw compressor's; 8 for IHI; 8 for oilless screw compressor |

In conclusion, the compressor of the present invention is superior to the conventional screw compressor and small compressor in performance. The inventive compressor has high supply pressure and high energy efficiency, and if a 110,000-RPM gear is employed, a compressor of less than 50 hp. can be manufactured. In the meantime, the inventive compressor's efficiency is lowered compared to a large turbo compressor's but it is excellent as a small turbo a compressor.

The present invention is compared with the IHI's compressor by calculating the performance when the output pressure is 8 bar like the IHI's 100-hp compressor that is known as the smallest one.

| | Present invention | IHI | Notes |
|---|---|---|---|
| Amount of gas for 1 hp. (CFM/HP) | 4.795 | 4.665 | 4 for conventional compressor |
| Energy efficiency | 0.874 | 0.849 | |

Figure 2:
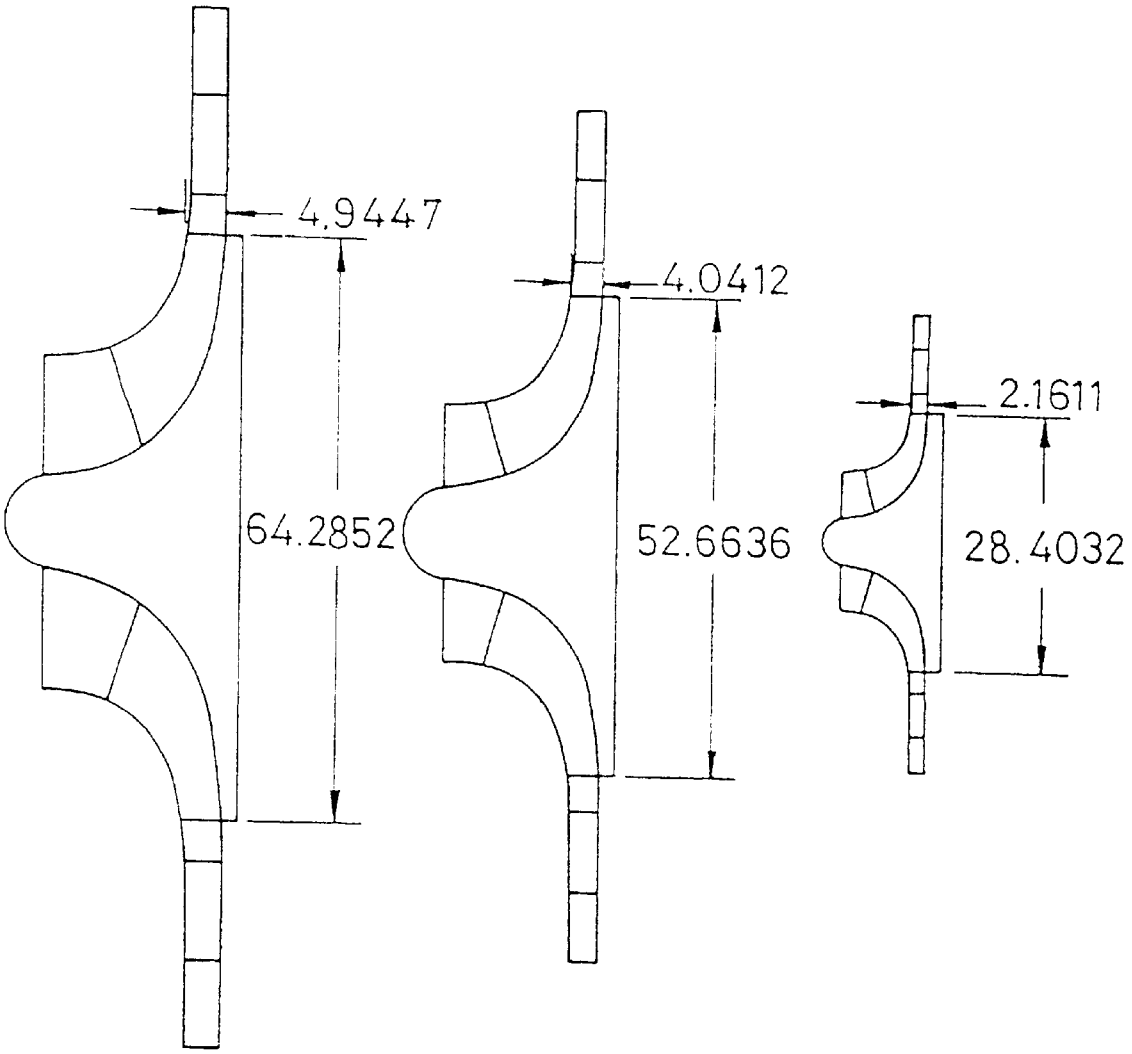
FIG. 2 depicts impellers for a 30-hp compressor.

If the pressure is lowered, the increase in the efficiency becomes small. When considering the mechanical loss, the efficiency of the present invention is similar to IHI's. Up to now, there is no turbo compressor of less than 100 hp. chat is of practical use, and such a manufacture of a compressor of 100 hp by using the present invention is of great significance FIG. 2 shows an example of an impeller of each centrifugal compressor (first-stage, second-stage and third-stage compressors form the left) 110,000-RPM, 110,000-RPM, and 220,000-RPM gears are respectively used for first-, second- and third-stage compressors. Outlet widths of the impellers are 4.94 mm, 4.02 mm, and 2.16 mm, respectively, and the efficiency of each stage is 80%, 82.9% and 82,3%, which shows that the compressors are manufactured in the optimum rotational speed (about 100). If the third-stage compressor uses a 110,000 RPM gear, its outlet width of 2.16 mm becomes less than 1.0 mm, which increases a loss due to leakage, and cannot be of practical use.

Figure 3:
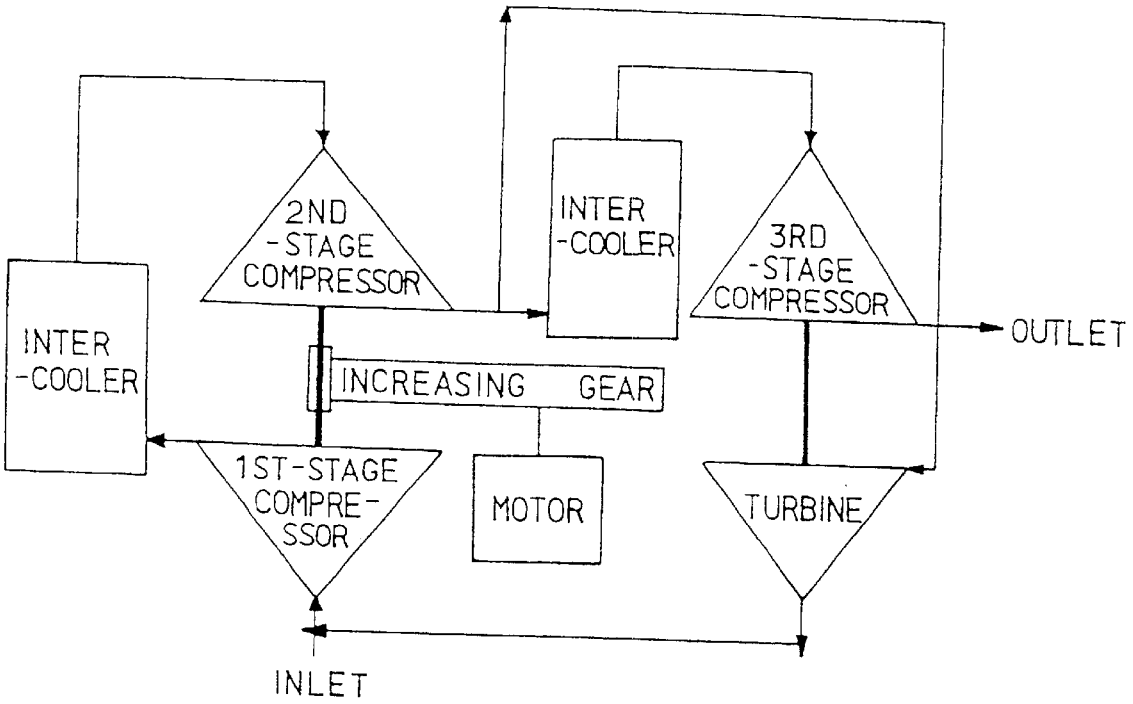
FIGS. 3 and 4 each depict modified examples of the present invention.
Figure 4:
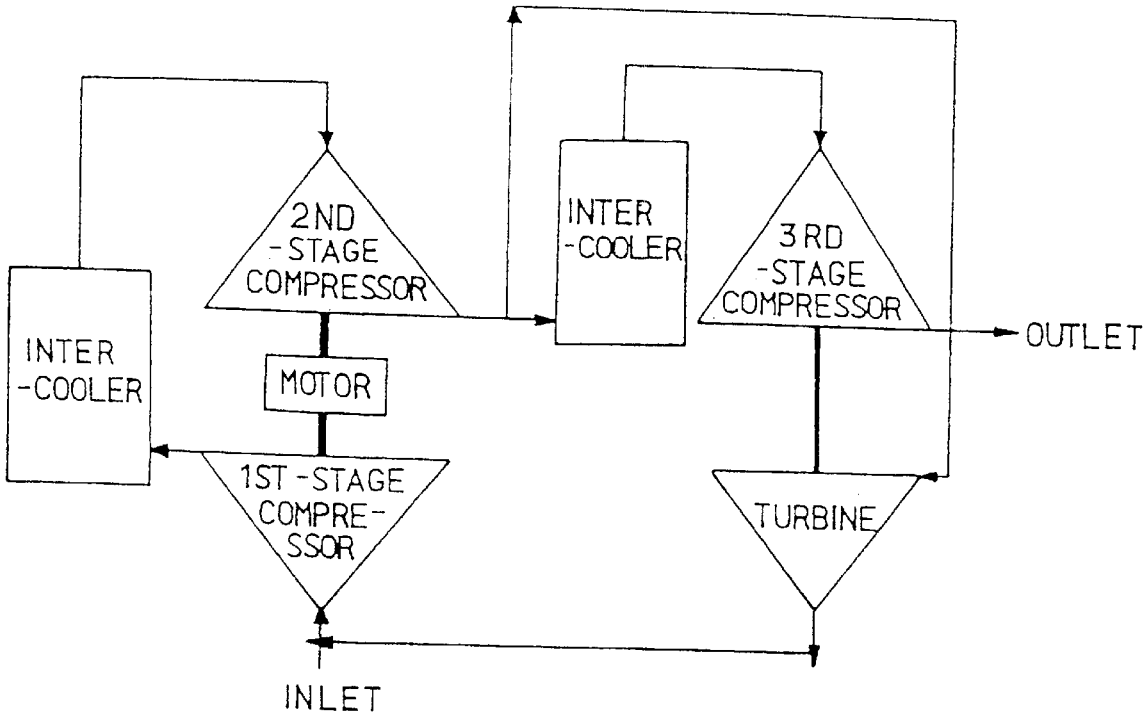

FIG. 3 depicts an example of driving first- and second-stage compressors by using a gear, and FIG. 4 shows an example of driving first- and second-stage compressors directly connected to a high-speed motor. Referring to FIG. 1, the power consumed by the first-stage compressor can be saved by returning the air, passed the turbine, to the inlet, and when discharging the air to the outside, if necessary, it can serve as an air conditioner(the outlet temperature of the turbine is about 6 C during summer). in the case where the discharged air is returned to the inlet, the inhaled air does not leak to the outside, and different kinds of gases other than the air may be used.

As described above, the small turbo compressor of the present invention provides the following advantages: first, the present invention is capable of providing a high pressure with a small amount of gas that the conventional turbo compressor cannot provide; second, according to the present invention, a turbo compressor can be manufactured without using any precise gear; third, the present invention can supply clean air without oil that the conventional screw compressor cannot provide; and fourth, the trouble-free inventive compressor assures a long-time use while the conventional screw compressor is of low durability and needs frequent repairs.

The inventive small turbo compressor has the above features, and can replace the conventional screw compressors as 50-hp to 200-hp air compressors.

Although the preferred embodiments of the present invention have been disclosed for illustrative purposes, chose skilled in the art will appreciate that various modifications, additions and substitutions are possible, without departing from the scope and spirit of the invention as recited in the accompanying claims.

What is claimed is:

1. A multi-stage turbo compressor for providing clean compressed air, said turbo compressor comprising:

a low-stage compressor having an inlet and outlet, said low-stage compressor including a first-stage compressor having an inlet and an outlet, and an impeller at said outlet, a second-stage compressor having an inlet and an outlet, and an impeller at said outlet, and an intercooler positioned between said first-stage outlet and said second-stage inlet for reducing consumption of power;

a turbine driven by a high-pressure gas from said outlet of said low-stage compressor; and a third-stage compressor connected to said turbine and said low-stage compressor for operating at more than 100,000 RPM with a small amount of gas.

2. The multi-stage turbo compressor according to claim 1, wherein the gas that passes the turbine is returned to said inlet of said first-stage compressor.

3. The multi-stage turbo compressor according to claim 1, wherein first-stage compressor and second-stage compressor are driven by a high-speed motor directly connected thereto.

4. The multi-stage turbo compressor according to claim 1, wherein said first-stage compressor is driven by a motor and an increasing gear.

5. The multi-stage turbo compressor according to claim 1, wherein said second-stage compressor is driven by a motor and an increasing gear.

6. The multi-stage turbo compressor according to claim 1, wherein said first-stage compressor includes an impeller with 110,00-RPM gears.

7. The multi-stage turbo compressor according to claim 1, wherein said second-stage compressor includes an impeller having 110,000-RPM gears.

8. The multi-stage turbo compressor according to claim 1, wherein said third-stage compressor includes an impeller having 220,000-RPM gears.

9. The multi-stage turbo compressor according to claim 4, wherein said first-stage impeller having an outlet width of 4.94 mm, and said first-stage impeller having a rotational speed efficiency of 80%.

10. The multi-stage turbo compressor according to claim 5, wherein said second-stage impeller having an outlet width of 4.02 mm, and said second-stage impeller having a rotational speed efficiency of 82.9%.

11. The multi-stage turbo compressor according to claim 6, wherein said third-stage impeller having an outlet width of 2.16 mm, and said third-stage impeller having a rotational speed efficiency of 82.3%.

* * * * *